US010278251B1

(12) United States Patent
Fledderman et al.

(10) Patent No.: US 10,278,251 B1
(45) Date of Patent: Apr. 30, 2019

(54) LIGHT DEVICE SYSTEM AND METHOD

(71) Applicants: Optic Arts, Inc., Monterey Park, CA (US); Endicott Research Group, Inc., Endicott, NY (US)

(72) Inventors: Joseph Fledderman, Endicott, NY (US); Mason Barker, Alhambra, CA (US)

(73) Assignees: Optic Arts, Inc., Monterey Park, CA (US); Endicott Research Group, Inc., Endicott, NY (US)

( * ) Notice: Subject to any disclaimer, the term of this patent is extended or adjusted under 35 U.S.C. 154(b) by 0 days.

(21) Appl. No.: 15/905,626

(22) Filed: Feb. 26, 2018

(51) Int. Cl.
*H05B 33/08* (2006.01)
*H05B 37/02* (2006.01)

(52) U.S. Cl.
CPC ..... *H05B 33/0863* (2013.01); *H05B 33/0845* (2013.01); *H05B 37/0263* (2013.01); *H05B 37/0272* (2013.01)

(58) Field of Classification Search
None
See application file for complete search history.

(56) References Cited

U.S. PATENT DOCUMENTS 6,636,003 B2 10/2003 Rahm et al.
8,330,394 B2 12/2012 Custodis
8,368,636 B2 2/2013 Shteynberg et al.
8,410,720 B2 4/2013 Holec et al.
8,710,754 B2 4/2014 Baddela et al.
8,791,640 B2 7/2014 Steele et al.
8,947,002 B2 2/2015 Le Toquin
(Continued)

FOREIGN PATENT DOCUMENTS

CN 201964227 U 9/2011
CN 205480595 U 8/2016
(Continued)

OTHER PUBLICATIONS

Lutron, Color Tuning with Lutron Controls, http://www.lutron.com/TechnicalDocumentLibrary/048579.pdf.
(Continued)

*Primary Examiner* — Vibol Tan
(74) *Attorney, Agent, or Firm* — Franklin & Associates International Inc; Matthew Lambrinos

(57) ABSTRACT

The present technology is a light device system and method for controlling a dimming function of a light emitting diode (LED) device. The system includes at least one LED light source, a switch connected with the LED light source, and a microcontroller in communication with the switch. The microcontroller receives a dimming signal from a dimming control and a production curve from an interface, and applying an output signal to the switch. The output signal is at least partially based on the production curve that is at least partially based on an input received by the interface. The interface is associated with software that allows a user to create a custom production curve, which can then be programmed into the microcontroller. The production curve replicates dimming characteristics of incandescent lighting by associating with a coordinated-color-temperature. The LED light source can be multiple LED light sources of different color temperature.

32 Claims, 7 Drawing Sheets

(56) References Cited

U.S. PATENT DOCUMENTS

| | | | | |
|---|---|---|---|---|
| 8,957,602 | B2 | 2/2015 | Zhang et al. | |
| 9,072,142 | B2 | 6/2015 | Zijlstra et al. | |
| 9,241,384 | B2 | 1/2016 | van de Ven et al. | |
| 9,301,359 | B2 | 3/2016 | Wray | |
| 9,347,631 | B2 | 5/2016 | Briggs | |
| 9,510,418 | B2 | 11/2016 | Bhagwat et al. | |
| 9,510,419 | B2 * | 11/2016 | Bell | H05B 33/0863 |
| 9,538,604 | B2 | 1/2017 | Yadav et al. | |
| 9,549,448 | B2 * | 1/2017 | Pope | H05B 33/0863 |
| 9,642,207 | B2 | 5/2017 | Cash | |
| 9,648,696 | B2 * | 5/2017 | Weaver | H05B 33/0869 |
| 9,668,307 | B2 | 5/2017 | Roberts et al. | |
| 9,681,512 | B1 * | 6/2017 | Xiong | H05B 33/0845 |
| 9,739,472 | B1 | 8/2017 | Li | |
| 9,763,300 | B2 | 9/2017 | O'Neil et al. | |
| 9,781,813 | B2 * | 10/2017 | Johnson | H05B 37/0263 |
| 9,854,640 | B2 * | 12/2017 | Hsia | H05B 33/0827 |
| 9,860,949 | B2 * | 1/2018 | Tyson | H05B 37/0272 |
| 9,867,254 | B2 * | 1/2018 | Petluri | H05B 33/0857 |
| 2013/0093362 | A1 * | 4/2013 | Edwards | H01L 25/0753 315/313 |
| 2014/0210357 | A1 | 7/2014 | Yan et al. | |
| 2016/0128155 | A1 | 5/2016 | Petluri et al. | |
| 2016/0295656 | A1 | 10/2016 | Lenk | |

FOREIGN PATENT DOCUMENTS

| | | | | |
|---|---|---|---|---|
| WO | 2009093895 | A1 | 7/2009 | |
| WO | 2016037994 | A1 | 3/2016 | |
| WO | 2016127014 | A1 | 8/2016 | |
| WO | WO 2017189571 | A1 * | 11/2017 | H05B 33/0863 |

OTHER PUBLICATIONS

Elemental LED, For the First Time, You Can Control Your Led Strip Lights Color Temperature, https://www.elementalled.com/for-the-first-time-you-can-control-your-led-strip-lights-color-temperature/.

SuperlightingLED, Color Temperature Pure White+Warm White Series DC24V 3014SMD 1120LEDs Flexible LED Strip Lights, http://www.superlightingled.com/color-temperature-pure-whitewarm-white-series-dc24v-3014smd-1120leds-flexible-led-strip-lights-164ft-per-reel-by-sale-p-128.html.

SuperbrightLEDs, Color Temp LED Controller, https://www.superbrightleds.com/cat/color-temp-controller/.

Light Show West, Dim to Warm, http://www.lightshowwest.com/dim-to-warm.

USAI Lighting, Color Select, http://www.usailighting.com/color-select.

* cited by examiner

LIGHT DEVICE SYSTEM AND METHOD

BACKGROUND

Technical Field

The present technology relates to a lighting device systems and methods, and more particularly but not exclusively, to light device systems, methods and/or user interfaces for controlling dimming of one or more light emitting diode (LED) devices.

Background Description

The use of LED dim to warm technology is known in the prior art for constant current LED fixtures. Several constant voltage solutions now exist including discrete drivers as well as passive solutions using resistors on an LED strip.

The coordinated-color-temperature (CCT) of a light is measured by finding the closest black-body radiation emission temperature of the light, and so is measured in degrees Kelvin (K). A typical incandescent light bulb, as it is dimmed, changes from about 2800K to about 1800-2000K. The relationship between a dim level, measured by average voltage applied over a line cycle, and CCT is non-linear.

LED light devices, strips and/or engines are known in the prior art, and work by applying a DC current through them. The amount of light emitted by a LED is approximately proportional to the magnitude of the current. It is thus common to dim LEDs by controlling their current as a function of the dim level, which is determined by either the average or RMS voltage, or by the DC 0-10V signal.

SUMMARY

In view of the foregoing disadvantages inherent in the known types of LED dim to warm technology now present in the prior art, the present technology provides a novel light device system and method, and overcomes any one or more of the mentioned or otherwise disadvantages and drawbacks of the prior art. As such, the general purpose of the present technology, which will be described subsequently in greater detail, is to provide a new and novel light device system and method and method which has one or more novel combination of features that result in a light device system and method which is not anticipated, rendered obvious, suggested, or even implied by the prior art, either alone or in any combination thereof.

According to one aspect of the present technology, the present technology can essentially include a light device system comprising at least one LED light source, at least one switch operably connected to the LED light source, and at least one microcontroller in operable communication with the switch. The microcontroller can be configured to receive a dimming signal from a dimming control and at least one production curve from an interface. The microcontroller can be further configured to apply at least one output signal to the switch. The production curve can be associated with the LED light source. The output signal can be at least partially based on the production curve. The production curve can be at least partially based on at least one input received by the interface.

According to another aspect of the present technology, the present technology essentially can include a light device interface system comprising an interface, and at least one microcontroller. The interface can be associated with a computer system that can have at least one processor and at least one computer-readable storage media in communication with the processor. The interface can comprise at least one input receivable and usable in determining at least one production curve associated with at least one light source characteristic. The microcontroller can be in operable communication with at least one switch operably connected to at least one LED light source. The microcontroller can be configured to receive a dimming signal from a dimming control and the production curve from the interface or the computer system. The microcontroller can be configured to apply at least one output signal to the switch. The output signal can be at least partially based on the production curve. The production curve can be a default curve stored in the microcontroller or it can be created by using the input in at least one mathematical function.

According to yet another aspect of the present technology, a method of controlling a light device can include the steps of determining at least one production curve based on at least one input received by an interface or a computer system. Writing the production curve to a microcontroller or selecting the production curve from the microcontroller. Receiving by the microcontroller a dimming signal from a dimming control. Creating by the microcontroller at least one output signal that is based on the production curve and the dimming signal. Transmitting the output signal from the microcontroller to at least one switch operably connected to at least one LED light source. Controlling at least one attribute of the LED light source by way of the switch based on the output signal.

The present technology may also include (brief description of additional elements and features that are not in the claims but might be claimed). There are, of course, additional features of the present technology that will be described hereinafter and which will form the subject matter of the claims attached.

BRIEF DESCRIPTION OF THE DRAWINGS

The present technology will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENTS

Figure 1:
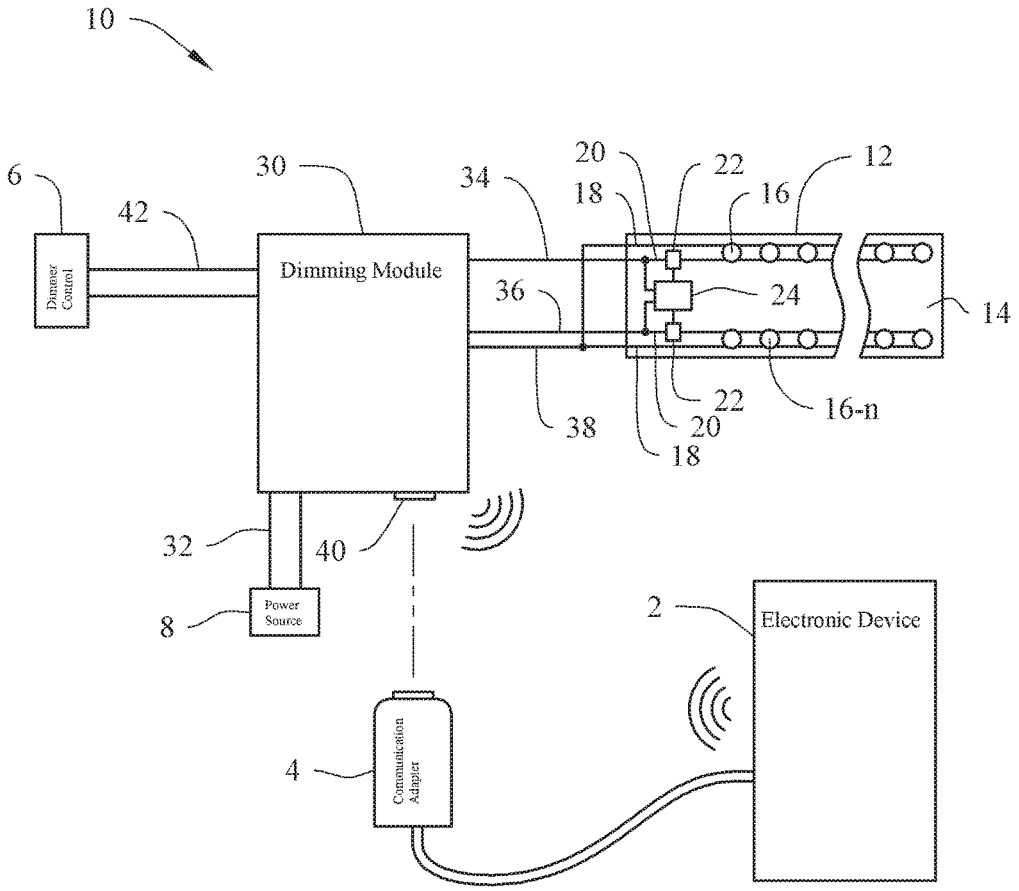
FIG. 1 is a block diagram of an embodiment of the light device system and method constructed in accordance with the principles of the present technology, with phantom lines depicting environmental structure and forming no part of the claimed present technology.

In the following description, for purposes of explanation and not limitation, specific details are set forth, such as particular embodiments, procedures, techniques, etc. in order to provide a thorough understanding of the present technology. However, it will be apparent to one skilled in the art that the present technology may be practiced in other embodiments that depart from these specific details.

It is known that a problem exists when dimming LED lights. A common form of LED is a "white" LED, which can be designed to have a CCT along the black-body curve, typically between 2000K-6000K. Typically, the CCT of a LED is basically not adjustable. Color temperatures over 5000K are called "cool colors" (bluish white), while lower color temperatures (2700-3000K) are called "warm colors" (yellowish white through red). When the current through them is reduced, they produce less light, but the CCT is unaffected. White LEDs thus do not produce the same type of light output on a dimmer, in comparison with an incandescent light bulb.

The typical method of solution to this problem in an LED light is to use a variety of different colored LEDs, such as a combination of red, green and blue (RGB), and to mix their light emissions together optically. The amount of current in each may be designed to produce white light of a particular CCT, for example that of an incandescent bulb at full brightness. When used with a dimmer, the ratios of currents in the different colors is varied in such a way as to produce a desired arbitrary CCT, and in particular, one that is close to that of an incandescent being similarly dimmed.

Incandescent light bulb dimmers are known, and incandescent bulbs have specific and recognizable characteristics as they dim. Incandescent lights warm as they dim, but LEDs do not exhibit the same effect. Consequently, as the light gets dimmer, it also becomes redder, so-called "warm-on-dim". The change in color of the light is known and measured as CCT. To mimic this effect a dim to warm solution is typically used which employs multiple LED colors to simulate a warming effect as the LED device dims. Microcontrollers have been used to control the currents supplied to the different colored LEDs, which is under the control of software. However, this typically requires expensive and complex circuitry, without the ability to reprogram the microcontroller with different dimming and/or color curves.

It is desirable to have an LED light device that can be dimmed to mimic the light output of an incandescent bulb, both in brightness and in CCT, when operated on either a triac or 0-10V dimmer. It would be further desirable to be able to reprogram the microcontroller with at least one production curve (dimming and/or color curves) so as to bring a dimming functionality to constant voltage LED strips while satisfying different preferences. The programmability also allows a user to set the CCTs of each string of LEDs on the strip, allowing the effect to work across a wide range of existing strips without and customization or modification of the strip itself.

While the above-described devices fulfill their respective, particular objectives and requirements, the aforementioned devices, systems or methods do not describe a light device system and method that allows controlling a dimming function of a LED light device. The aforementioned devices, systems or methods further do not describe the replication of dimming characteristics of incandescent lighting by programming at least one production curve associated with CCT into a microcontroller of the LED light device.

The present technology additionally overcomes one or more of the disadvantages associated with the prior art by that the microcontroller can be reprogrammed with custom production curves generated by a software application based on user inputs for dim to warm characteristics, in possible combination with the microcontroller output being dependent with a dimmer signal for controlling at least one LED light strip switch.

A need exists for a new and novel light device system and method that can be used for controlling a dimming function of a LED light device. In this regard, the present technology substantially fulfills this need. In this respect, the light device system and method according to the present technology substantially departs from the conventional concepts and designs, and in doing so provides an apparatus primarily developed for the purpose of controlling a dimming function of a LED light device.

Technical features described in this application can be used to construct various embodiments of light device systems. In some approaches, lighting device systems, methods and/or circuits for use in connection with controlling a dimming function of a LED light device are provided. The systems, methods and/or devices of some embodiments are configured to replicate dimming characteristics of incandescent lighting. This is achieved by programming of at least one production curve associated with a CCT into a microcontroller of the LED light device.

A light device system can include at least one LED light source, at least one switch operably connected to the LED light source, and at least one microcontroller in operable communication with the switch. The microcontroller can be configured to receive a dimming signal from a dimming control and at least one production curve from an interface. The microcontroller can further be configured to apply at least one output signal to the switch. The production curve can be associated with the LED light source, with the output signal being at least partially based on the production curve. The production curve can be at least partially based on at least one input received by the interface.

In some embodiments of the approach, the LED light source can be a first and second LED light source of different color temperature. The first LED light source can have a first LED anode and a first LED cathode, and the second LED light source can have a second LED anode and a second LED cathode. A dimming module can be operably connected with the first and second LED sources.

In some embodiments, the switch can be a first switch operably connected between the dimming module and the first LED cathode of the first LED light source, and a second switch operably connected between the dimming module and the second LED cathode of the second LED light source.

In some aspects, the first and second light source can each be a constant voltage LED strip of different color temperature.

In some embodiments, the input can be at least one brightness value or at least one CCT value associated with each of the first and second LED light source.

In some aspects, the production curve can be each selected from the group consisting of a color curve associated with color temperatures along a predetermined voltage range, a brightness curve associated with brightness along the predetermined voltage range, and the color curve and the brightness curve.

In some aspects, the output signal can be at least two independent output signals each associated with a duty cycle step, and the input is a cool LED color temperature value and a warm LED color temperature value.

In some embodiments, one of the duty cycle step can be based on the production curve being an average CCT associated with a warm LED duty cycle percentage and a cool LED duty cycle percentage.

In some aspects, a second of the duty cycle step is based on a second curve being a brightness associated with a warm LED duty cycle value, a cool LED duty cycle value, and a maximum combined duty cycle value determined by the input.

In another approach, the present technology provides a light device controller including at least one microcontroller in operable communication with at least one switch and with a dim to warm module including an interface or a computer system. The switch can be operably connected with at least one LED light source. The microcontroller can be configured to:

receive a dimming signal from a dimming control;

be programmed with at least one production curve from the interface or the computer system; and apply at least one output signal to the switch.

The output signal can be at least partially based on the production curve. The production curve can be associated with at least one characteristic of the LED light source. The production curve can be at least partially based on at least one input received by the interface or the computer system.

In still another approach, the present technology provides a light device interface system including an interface associated with a computer system having at least one processor, at least one computer-readable storage media in communication with the processor. The interface can include at least one input receivable and usable in determining at least one production curve associated with at least one light source characteristic. At least one microcontroller can be in operable communication with at least one switch operably connected to at least one LED light source. The microcontroller can be configured to receive a dimming signal from a dimming control and the production curve from the interface or the computer system. The microcontroller can be further configured to apply at least one output signal to the switch, with the output signal being at least partially based on the production curve. The production curve can be a default curve stored in the microcontroller or created by using the input in at least one mathematical function.

In some embodiments of the approaches, the LED light source being a first and second LED light source of different color temperature. The input can be a first input being at least one brightness value or at least one CCT value associated with the first LED light source, and a second input being at least one brightness value or at least one CCT value associated with the second LED light source.

In some aspects, the interface can further include a graphical object wherein characteristic points representing at least one predefined characteristic are located at predefined coordinates in a Cartesian coordinate system, and a graphical representation of the production curve displayed in the graphical object. The input can be selected on at least one of the characteristic points on the graphical representation of the production curve displayed in said graphical object.

In some embodiments, the interface can further include an additional input for moving the selected characteristic point on the graphical representation resulting in the mathematical function calculating an updated production curve.

In some embodiments, the production curve can be a color curve associated with color temperatures along a predetermined voltage range, with the color temperatures of the color curve being based on the input from the interface.

In some aspects, the production curve can further include a brightness curve associated with brightness along the predetermined voltage range.

In some aspects, the output signal can be each at least two independent output signals each associated with a duty cycle step, and the input can be a first input being a cool LED color temperature value and a second input being a warm LED color temperature value. One of the duty cycle step can be based on the production curve being an average CCT associated with a warm LED duty cycle percentage and a cool LED duty cycle percentage.

In some embodiments, the production curve can include predefined color temperature targets with set points based on an incandescence curve associated with brightness and color temperature characteristics of a dimmable incandescent light.

In further aspects, the computer-readable storage media storing instructions that, when executed by the processor, causes the processor to:

compile a code including the production curve;

determine what coefficients need to change in the code based on the input;

change the coefficients in the code to alter the production curve in the code; and store the code in the microcontroller.

In still yet another approach, the present technology provides a method of controlling a light device that can include the steps of:

determining at least one production curve based on at least one input received by an interface or a computer system;

writing the production curve to a microcontroller or selecting the production curve from the microcontroller;

receiving by the microcontroller a dimming signal from a dimming control;

creating by the microcontroller at least one output signal that is based on the production curve and the dimming signal;

transmitting the output signal from the microcontroller to at least one switch operably connected to at least one LED light source; and controlling at least one attribute of the LED light source by way of the switch based on the output signal.

In some embodiments of the approaches, the LED light source being a first and second LED light source of different color temperature. The input can be at least one brightness value or at least one CCT value associated with each of the first LED light source and the second LED light source. The production curve can be each selected from the group consisting of a color curve associated with color temperatures along a predetermined voltage range, a brightness curve associated with brightness along the predetermined voltage range, and the color curve and the brightness curve.

In some aspects, the output signal can be each at least two independent output signals each associated with a duty cycle step, and the input is a cool LED color temperature value and a warm LED color temperature value. One of the duty cycle step can be based on the production curve being an average CCT associated with a warm LED duty cycle percentage and a cool LED duty cycle percentage. A second of the duty cycle step can be based on a second production curve being a brightness associated with a warm LED duty cycle value, a cool LED duty cycle value, and a maximum combined duty cycle value determined by the input.

There has thus been outlined, rather broadly, features of the present technology in order that the detailed description thereof that follows may be better understood and in order that the present contribution to the art may be better appreciated.

Numerous objects, features and advantages of the present technology will be readily apparent to those of ordinary skill in the art upon a reading of the following detailed description of the present technology, but nonetheless illustrative, embodiments of the present technology when taken in conjunction with the accompanying drawings.

As such, those skilled in the art will appreciate that the conception, upon which this disclosure is based, may readily be utilized as a basis for the designing of other structures, methods and systems for carrying out the several purposes of the present technology. It is, therefore, that the claims be regarded as including such equivalent constructions insofar as they do not depart from the spirit and scope of the present technology.

An even further object of the present technology of one or more embodiments is to provide a new and novel light device system and method that has a low cost of manufacture with regard to both materials and labor, and which accordingly is then susceptible of low prices of sale to the consuming public, thereby making such light device system and method economically available to the buying public.

These together with other objects of the present technology, along with the various features of novelty that characterize the present technology, are pointed out with particularity in the claims annexed to and forming a part of this disclosure. For a better understanding of the present technology, its operating advantages and the specific objects attained by its uses, reference should be made to the accompanying drawings and descriptive matter in which there are illustrated embodiments of the present technology.

Whilst multiple objects of the present technology have been identified herein, it will be understood that the claimed present technology is not limited to meeting most or all of the objects identified and that some embodiments of the present technology may meet only one such object or none of the objects mentioned herein Referring now to the drawings, and particularly to FIGS. 1-9, an embodiment of the light device system and method of the present technology is shown and generally designated by the reference numeral 10.

In FIG. 1, a new and novel light device system and method 10 of the present technology for controlling a dimming function of a LED light device according to one embodiment is illustrated and will be described. More particularly, the light device system and method 10 replicates dimming characteristics of incandescent lighting by programming at least one production curve associated with CCT into a microcontroller of the LED light device. The present technology according to the embodiment of FIG. 1 includes at least one LED light source 12, and at least one dimming module 30 in operable communications with the LED light source 12. The dimming module 30 is configured or configurable to receive a dimming command or signal from a dimmer control 6 by way of a dimmer control wiring 42 or wireless communication, and is connected or connectable to a power supply or power source 8 utilizing power wiring 32. In other embodiments, the dimmer control 6 is integral with the dimming module 30 or the dimmer control 6 is omitted with the dimming signal being received from another source.

A software application including an interface is configured or configurable to be executed by a processor of the electronic device 2, and further configured to be usable in determining, receiving, generating and/or transmitting at least one production curve associated with at least one characteristic of the LED light source 12. The interface can be a graphical user interface (GUI) or any interface allowing variables to be inputted for execution by the software application.

The communication connection between the electronic device 2 and the dimming module 30 is configured to utilize a wired and/or wireless system using an appropriate protocol. For exemplary purposes, the electronic device 2 is configured to be in communication with a communication adapter 4, such as but not limited to a PicKit 3, universal serial bus (USB) adapter, and the like. The communication adapter 4 is configured to be connected to the dimming module 30 by way of a 5-pin programming connection 40.

The LED light source 12 is configured to include at least one flexible, rigid or semi-rigid printed circuit board (PCB) 14 to which is affixed at least one LED light strip 16 or multiple LED light strips 16-*n*. The LED light source 12 is configured to include LEDs of different color temperature. It is appreciated that the LED light strip 16, 16-*n* is, but not limited to, a LED tape, a LED strip, a LED engine, a single LED strip with different colored LEDs, multiple LED strips with each strip including a plurality of specific colored LEDs, or a plurality of PCBs with each PCB including a LED strip of a specific color. The LEDs may be a string or parallel combination of LEDs, or a parallel set of series strings of LEDs covering warm to cool CCTs.

The LED light strip 16, 16-*n* is configured or configurable to further include an anode 18 and a cathode 20. At least one switch 22 is configured to be in communication with the cathode 20 of the LED light strip 16, 16-*n*. The switch 22 is configured and capable of controlling power, current, voltage or a signal to the LED light strip 16, 16-*n* connected thereto, respectively. The switch 22 is configured to be pulse width modulated (PWM, PWMed).

A microcontroller 24 is configured or configurable to read a signal from each cathode 20 or wiring 34, 36 connected to the cathode 20 from the dimming module 30. The microcontroller 24 is reprogrammable, and is configured to be located on the PCB 14 or with the dimming module 30. The anode 18 is configured to be in communication with the dimming module 30 by common connection or wiring 38. The microcontroller 24 is capable of receiving a dimming signal from the dimmer control 6 and at least one production curve from the electronic device 2. The microcontroller 24 is also capable of applying, generating and/or transmitting at least one output signal to the one or more switches 22. The output signal from the microcontroller 24 is configured to be at least partially based on the production curve received from the electronic device 2 or from a default curve stored in the microcontroller 24.

Figure 2:
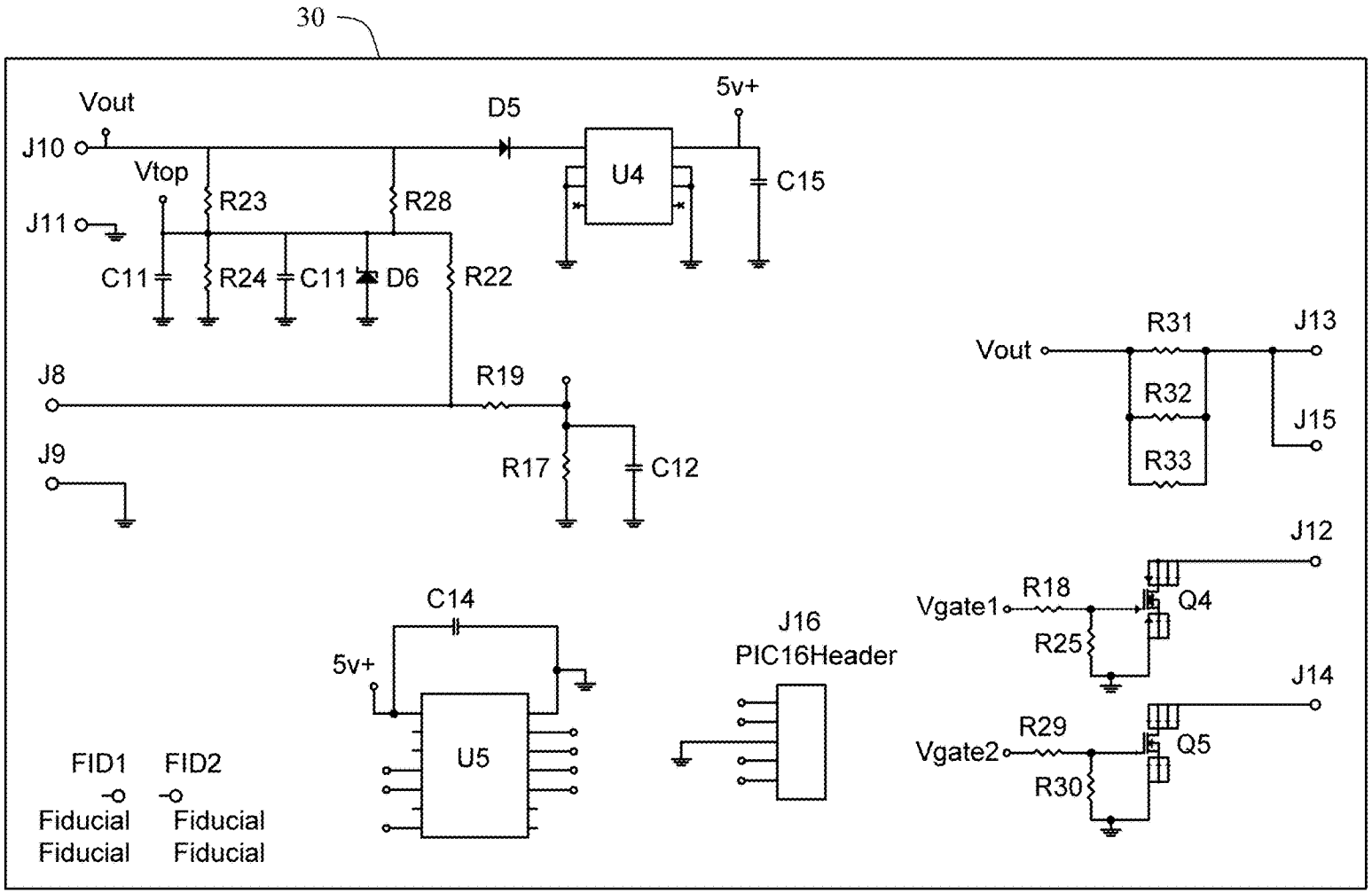
FIG. 2 is a circuit diagram of the dimming module of the present technology.

Referring to FIG. 2, an embodiment of the circuitry of the dimming module 30 is represented. The dimming module 30 is configured to include multiple circuitry stages or sections. The following labels followed by a numeral represents: C capacitor; D diode; R resistor; J connectors; U microchip; Q transistor; and FID fiducial marks.

Figure 3:
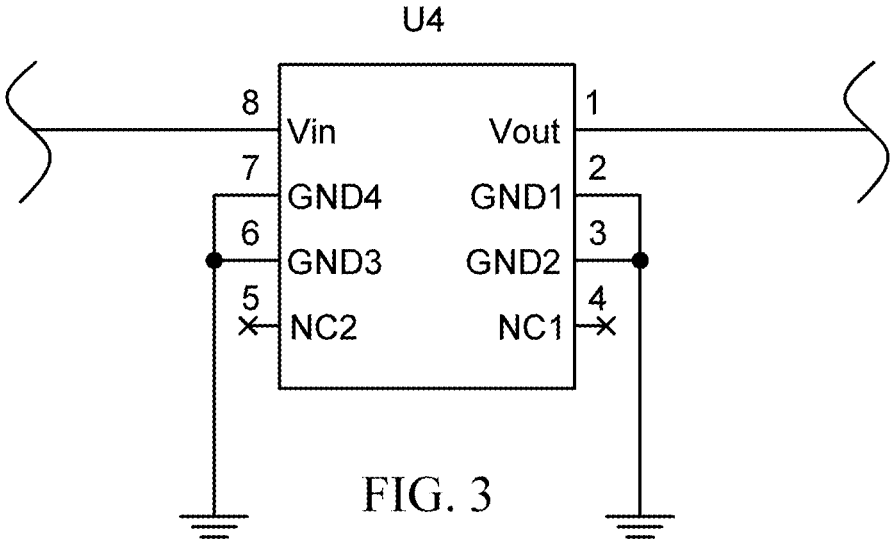
FIG. 3 is a circuit diagram of the regulator of the dimming module of the present technology.

The dimming module 30 is configured to include a regulator U4, which can be but not limited to, a 5V regulator. The regulator U4 is configured to receive a voltage input, such as 24V, and steps it down to 5V to provide power to the microcontroller 24 (U5) and to the programming connection 40 (J16). A possible pin arrangement for the regulator U4 is best illustrated in FIG. 3, which shows the voltage input and output being 5 v+.

The step down operation of the regulator U4 is characterized by the utilization of parallel circuits initiated with connectors J8 and J10. Resistors R22, R23 and R28 bridge the J8 and J10 circuits. The bridging circuitry includes capacitors C10 and C11, resistor R24, and diode D6.

The microcontroller U5 is capable of being connected to the programming connector J16, dimming field-effect transistors (FETs) Q4, Q5 and a dimming input from the dimmer control 6. The microcontroller U5 is reprogrammable by way of the programming connector J16.

The dimming FETs Q4, Q5 are associated with the cool and warm aspects of the LED light source 12 and/or the LED light strip 16, 16-*n*, respectively. Vgate1 and Vgate2 are PWM signals, operating at about, but not limited to, 1 kHz. The microcontroller U5 includes coding capable of determining what the PWM signals of Vgate1 and Vgate2 should be, based upon the curve programmed into the microcontroller U5 and the voltage level of the dimming input. It is appreciated that Vgate1 and Vgate2 are outputs of the microcontroller U5. The dimming FETs Q4, Q5 are driven by the Vgate1 and Vgate2 outputs, which then control the one or more switches 22.

Figure 4:
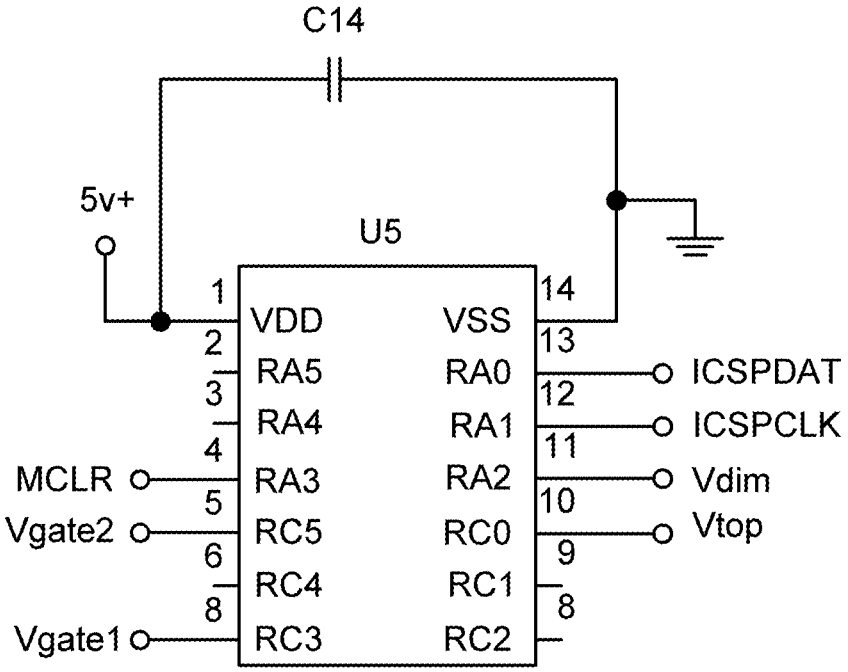
FIG. 4 is a circuit diagram of the microcontroller of the dimming module of the present technology.

The microcontroller U5 is capable of receiving the stepped down voltage (5 v+) from the regulator U4. A capacitor C14 is in parallel with the microcontroller U5. A possible pin arraignment for the microcontroller U5 is best illustrated in FIG. 4, which shows the dimmer controller voltage input (Vdim), a voltage input (Vtop) and the stepped down voltage (5 v+) from the regulator U4, and the Vgate1 and Vgate2 outputs. The microcontroller U5 may have proprietary and reprogrammable firmware, and is configured to have a variety of input and/or output pins to handle interface input signals. For example, the microcontroller U5 may be capable of receiving new firmware from the programming connector J16 by way of the MCLR, ICSPDAT and/or ICSPCLK connection. The firmware is configured to include one or more production curves for any or all of the LED light strips 16, 16-*n*.

Figure 5:
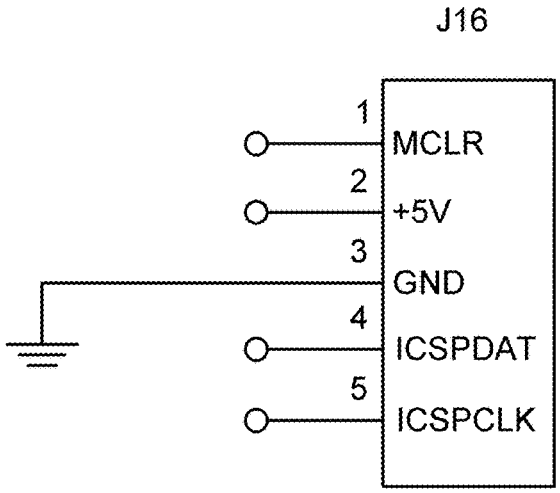
FIG. 5 is a circuit diagram of the programming connection of the dimming module of the present technology.

A possible pin arrangement of the programming connector J16 is best illustrated in FIG. 5. The programming connector J16 is configured to communicate and/or connect with the electronic device 2. It is appreciated that any wireless protocol and hardware is capable of being utilized in place of the programming connector J16 to provide communication between the electronic device 2 and the dimming module 30.

It is appreciated that the microcontroller U5 is capable of being reprogrammed with new firmware from the electronic device 2 by way of the programming connector J16.

Figure 6:
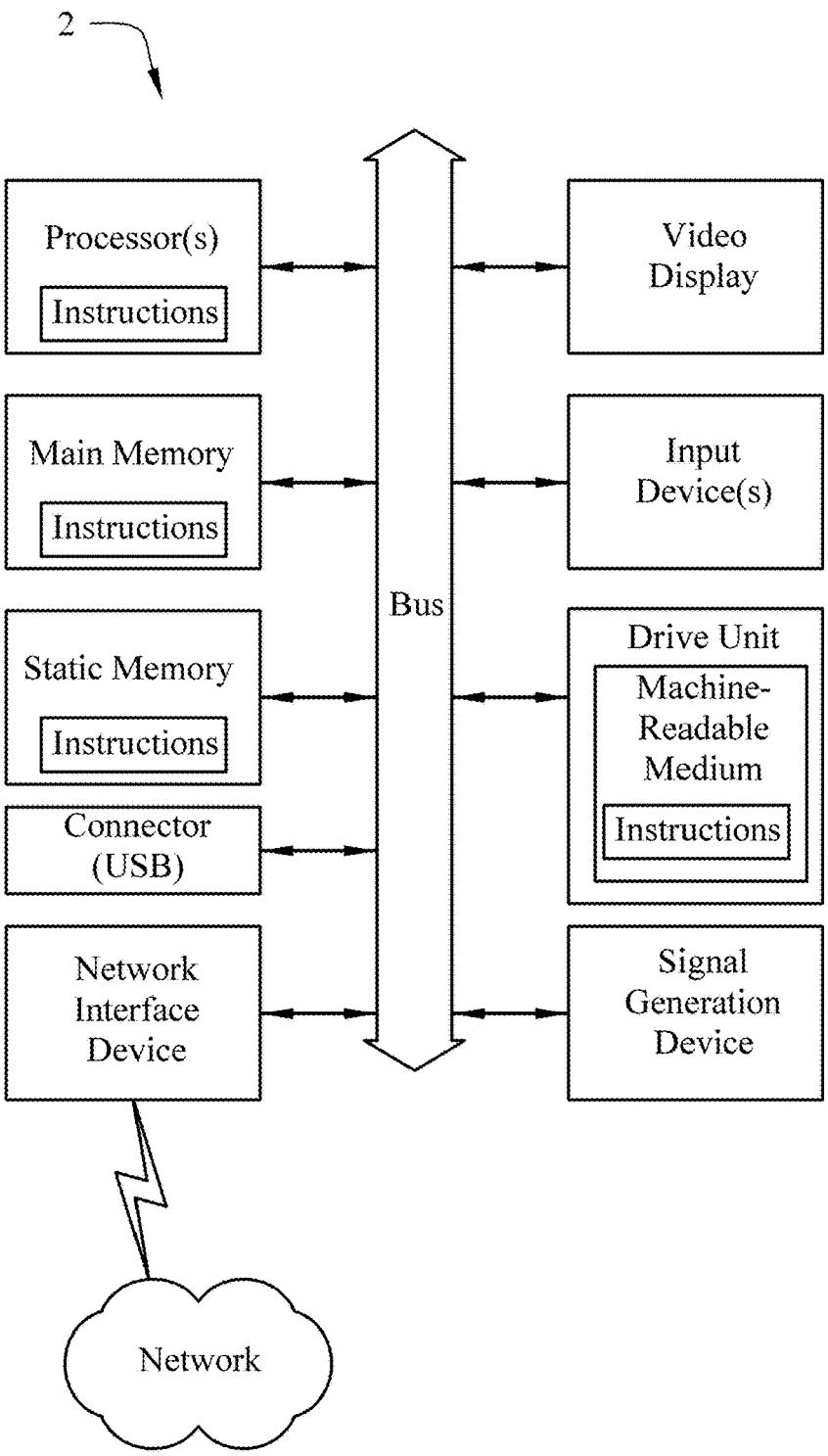
FIG. 6 illustrates an exemplary electronic computing device that may be used to implement an embodiment of the present technology.

A companion software application is associated with and/or executed by the electronic computing device, machine or system 2. FIG. 6 is a diagrammatic representation of an example machine in the form of the electronic device 2, within which a set of instructions for causing the electronic device to perform any one or more of the methodologies discussed herein may be executed. In various example embodiments, the electronic device 2 operates as a standalone device or may be connected (e.g., networked) to other devices. In a networked deployment, the electronic device may operate in the capacity of a server or a client machine in a server-client network environment, or as a peer machine in a peer-to-peer (or distributed) network environment. The electronic device may be a personal computer (PC), a tablet PC, a set-top box (STB), a personal digital assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that device. Further, while only a single electronic device is illustrated, the term "device" shall also be taken to include any collection of devices that individually or jointly execute a set (or multiple sets) of instructions to perform any one or more of the methodologies discussed herein.

The example electronic device 2 includes a processor or multiple processors (e.g., a central processing unit (CPU), a graphics processing unit (GPU), or both), and a main memory and static memory, which communicate with each other via a bus. In other embodiments, the electronic device 2 may further include a video display (e.g., a liquid crystal display (LCD)). The electronic device 2 may also include an alpha-numeric input device(s) (e.g., a keyboard), a cursor control device (e.g., a mouse), a voice recognition or biometric verification unit (not shown), a drive unit (also referred to as disk drive unit), a signal generation device (e.g., a speaker), a universal serial bus (USB) and/or other peripheral connection, and a network interface device. In other embodiments, the electronic device 2 may further include a data encryption module (not shown) to encrypt data.

The drive unit includes a computer or machine-readable medium on which is stored one or more sets of instructions and data structures (e.g., instructions) embodying or utilizing any one or more of the methodologies or functions described herein. The instructions may also reside, completely or at least partially, within the main memory and/or within the processors during execution thereof by the electronic device 2. The main memory and the processors may also constitute machine-readable media.

The instructions may further be transmitted or received over a network via the network interface device utilizing any one of a number of well-known transfer protocols (e.g., Hyper Text Transfer Protocol (HTTP)). While the machine-readable medium is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the device and that causes the device to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware.

Figure 7:
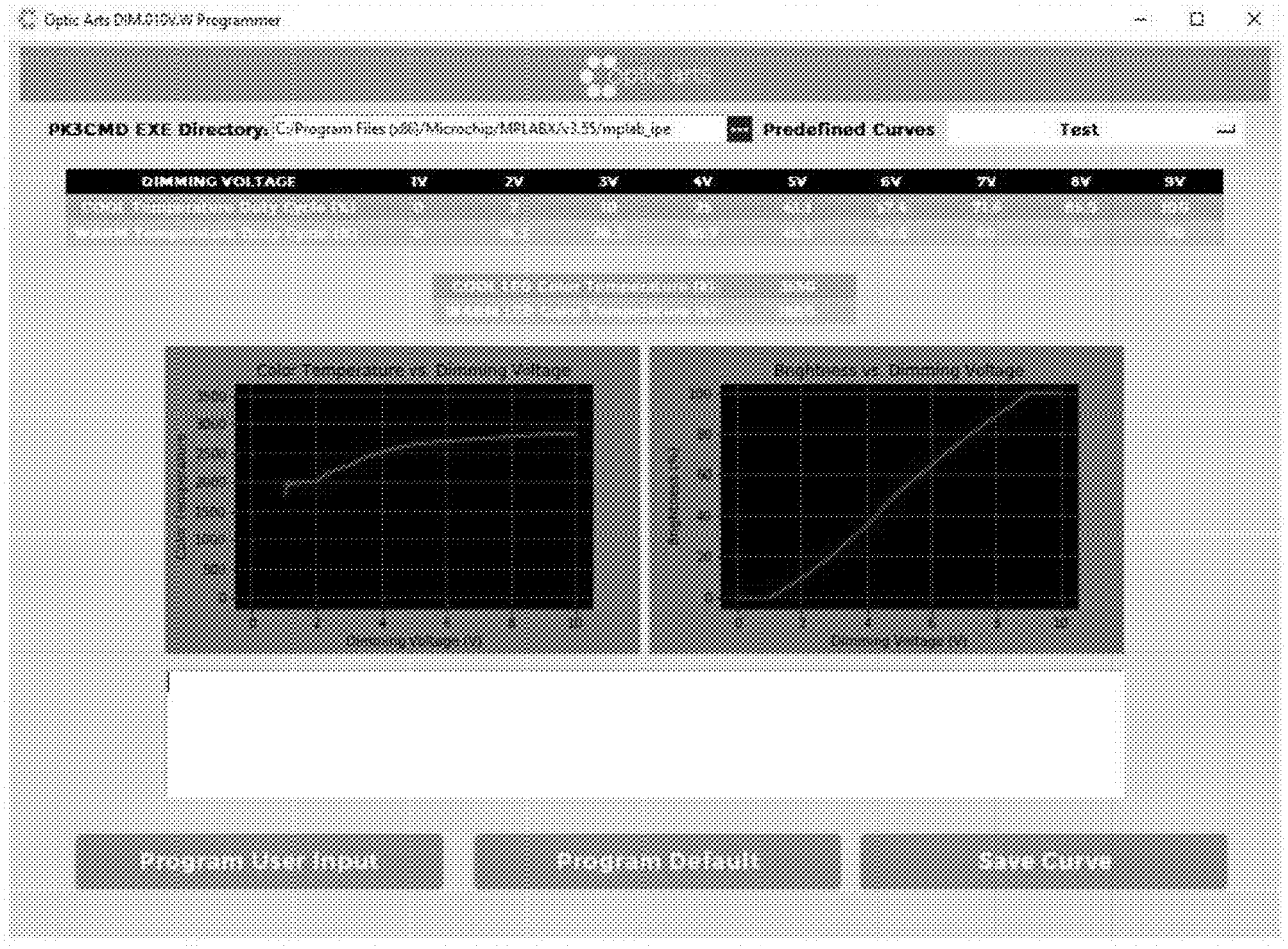
FIG. 7 is a sample graphical user interface (GUI) screenshot of the interface system of the present technology.

It is appreciated that the software application is configured or configurable to be stored in any memory of the electronic device 2 or on a remote computer in communication with the electronic device 2. The companion software application is configured or configurable to include the interface capable of allowing a user to define a custom dimming production curve for the LED light strip 16, 16-*n*, based upon the dimming input from the dimmer control 6. The interface is, but not limited to, a GUI interface, as best illustrated in FIG. 7, capable of providing a screen for device optimized parameters or variables.

The GUI interface is configured or configurable to include a dropdown menu providing default or predefined production curves that are uploadable to the microcontroller 24. Optionally, the GUI interface is configured or configurable to include areas or windows where CCT values are entered for the LED light strip 16, 16-*n*. The CCT values are associated with cool LED color temperature and/or warm LED color temperature. The dimming voltage range is configured or configurable to be predefined by the software application or defined by the user by entering values for the preset minimum and maximum voltage. The GUI is configured or configurable to be used to preset a minimum LED current as a percentage of the maximum LED.

Still further and optionally, the GUI interface is configured or configurable to provide CCT and brightness graphs of the LED light strip 16, 16-*n* versus dimming voltage. The user may click and drag or manipulate the CCT and/or brightness graph line, thereby altering the CCT and/or brightness value and consequently resulting in a new production curve. It is appreciated that the CCT and brightness graphs are separate and independent graphs or a single graph including both.

The GUI interface is configured or configurable to further include a display representing cool temperature duty cycle (%) and warm temperature duty cycle (%) versus dimming voltage.

Figure 9:
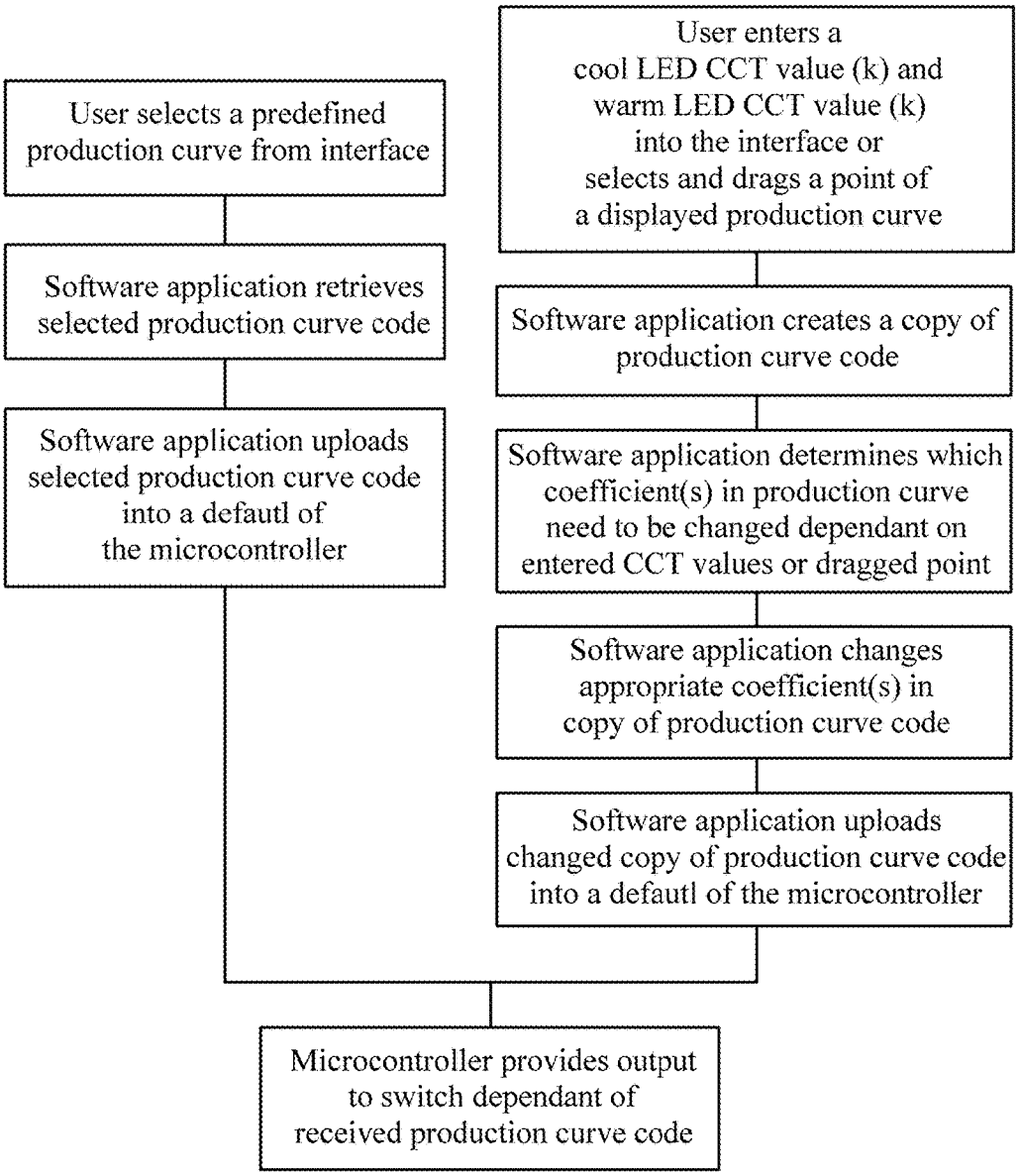
FIG. 9 is a flow chart of an example of how the production curve is determined using the interface and/or the software application, and uploaded into the microcontroller.

A possible process of the interface is illustrated in FIG. 9. The interface and/or software application allows the user to select a predefined default curve, to define a custom production curve by setting desired brightness for the LED light strip 16, 16-*n*, respectively, along a voltage range of the dimming input signal or select and drag a point on a production curve displayed in the interface. The brightness setting entered in by the user is optionally a cool LED CCT value (k) and a warm LED CCT value (k). The voltage range is, but not limited to, 0-10V. The software application, based upon the user brightness inputs, is configured or configurable to generate curves representing an approximate CCT for any dimming voltage and overall brightness curves. The software application is configured or configurable to also generate a new program or firmware to load into the microcontroller 24 (U5), and to save any generated production curves for later use.

To upload the new firmware and/or production curve to the dimming module 30, the user may connect the communication adapter 4 to the electronic device 2 and to the programming connector J16 of the dimming module 30. The user may then execute an upload operation in the software application, which uploads the new production curve to the microcontroller 24 (U5).

The software application is configured or configurable to and/or capable of including a preprogrammed set of default production curves to create a warm to dim characteristic of the LED light strip 16, 16-*n*. These default curves are configured or configurable to include temperature targets and a predetermined desired color temperature with, but not limited to, 4 or 5 set points. This is optionally based on an incandescence type curve. The default curves are configured or configurable to be adjusted after testing and/or user feedback.

The software application is configured or configurable to compile code, such as but not limited to, a hex file. The code is configured or configurable to be programmed into a default of the microcontroller 24 (U5). A copy of the hex file is created by the software application, and based on user inputs, the software application is configured or configurable to calculate what coefficients of the production curve need to change and then changes the coefficients to alter the already compiled production curve.

An algorithm is utilized to create the dimming to warm effect. The algorithm is configured or configurable to calculate a percentage warm LED and dim LED resulting in a weighted average. Some assumptions may be realized, such as but not limited to, that the LEDs are close together, and color temperate not further apart. This assumption could follow a curve path, with user inputs at every volt between points on the curve. Assuming linear increase between two end points, basically being segments of the production curve. This would result in the brightness and temperature at those two points going up to 9 volts.

A further assumption of the software application is that light blends perfectly at 100%. A diffuser is configured or configurable to be utilized to assist in blending. Another assumption is that a resultant light will be a midpoint between 4K and 2K.

One of the inputs is configured or configurable to be used to define cool and warm temperatures. If the user is keeping them the same then the software application is capable of taking the two linear inputs. If the user is changing temperatures then the software application is capable of moving an end point on the curve.

Figure 8:
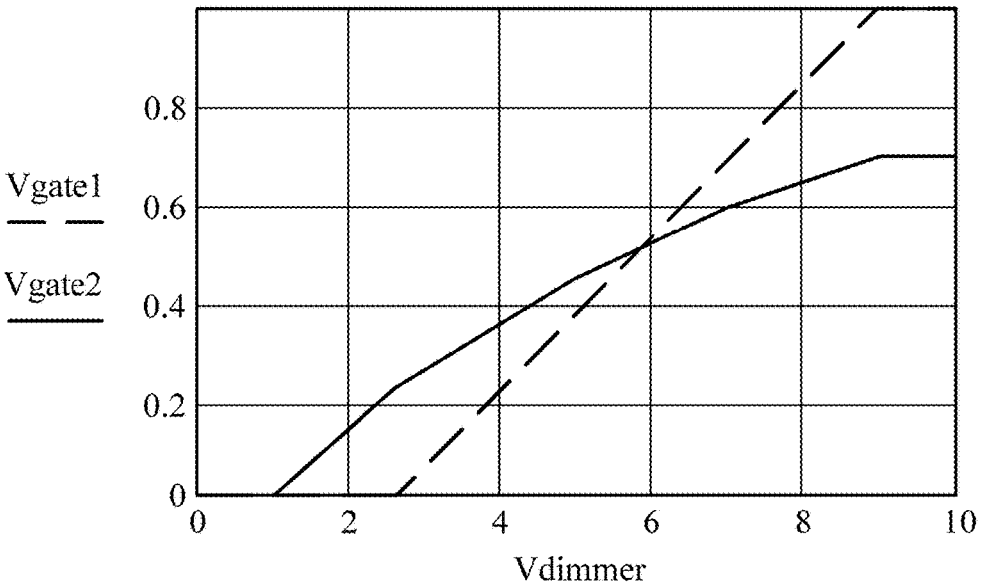
FIG. 8 is a graphical representation of an example of the production curve of the present technology.

For exemplary purposes, the production curve is configured have 5 or 8 break points from 1V to 9V that gets programmed, as best illustrated in the graph of FIG. 8. Vgate1 is the cool LED on percentage, and Vgate2 is the warm LED on percentage. It is appreciated that one or more graphs are associated with an overall brightness and CCT. It is further appreciated that the present technology is not limited to the use of the 1-9V range, and that a triac type dimmer is capable of being used.

The graph of FIG. 8 is represented with the X coordinate being a dimmer voltage range, and the Y coordinate being the duty cycle of the LED. The breakpoints for the cool curve are configured to be (0,0), (2.578,0), (8.98,1), (10,1), with the breakpoints for the warm curve being (0,0), (0.988, 0), (1.063, 0.014), (2.578, 0.218), (4.984, 0.449), (6.982, 0.599), (8.98, 0.699), (10, 0.699).

When using the interface, the breakpoints for the piecewise linear segments are configured to be (0,y1), (1,y1), (2, y2), (3, y3), . . . , (9,y9), (10, y9), where the y values are the inputs from the user for each of the LED outputs. The software application assumes the user wants to hold the values set at 1V below 1V, and similarly it assumes the user wants to hold the value entered in at 9V above 9V.

After which, the software application is configured or configurable to determine a gain and offset of the linear function between each set point. It will then take a weighted average of the cool LED and warm LED's duty cycles to give an average color temp for that point. This operation occurs for each discrete point along the dimming input.

The microcontroller 24 (U5) is configured or configurable to have a 10-bit resolution, resulting in the differentiation of 1024 different steps. For each step, based on the user inputs, the software application is configured or configurable to determine the duty cycle for the LED light strip 16, 16-*n*. After the 1024 values are determined, the software application uses the higher combined duty cycle as 100% brightness, and scales everything else down from that point. The combined color temperature for each of the 1024 points is plotted.

A further assumption that may be implemented is that color mixing is linear (e.g. −50% of 3000K and 50% of 4000K will give a 3500K overall color temp). This assumption holds substantially true, but will become less so as the color temperatures of the two different LEDs become more extreme.

Still another assumption is that the color temperatures of the cool and warm strands are exactly what are entered by the user. There are possible inaccuracies with this assumption since LED light strings are capable of having a +/−100K tolerance on them. Any variation associated with this assumption may show up as an error in the graphs and in the code generated by the software application. For example, if a user enters in 3500K as a cool LED color, but the LED light string really measured 3450K, the calculated color temp will be off by as much as 50K. It is believed that any such error is insignificant and would not change the operation of controlling the one or more switches 22 in providing the desired LED dim characteristic per the production curve.

The algorithm is configured or configurable to generate the CCT utilizing a weighted average. For each of the 1023 possible dimming input steps, the CCT is calculated using the following equation 1:

$$AverageCCT = \frac{WarmDutyCycle \times WarmCCT + CoolDutyCyle \times CoolCCT}{WarmDutyCycle + CoolDutyCycle} \quad \text{Equation 1}$$

Similarly, the brightness for each of the 1023 input steps are calculated using the following equation 2:

$$\text{Brightness} = \frac{WarmDutyCycle + CoolDutyCycle}{MaxCombinedDutyCycle} \quad \text{Equation 2}$$

The MaxCombinedDutyCycle is determined by looking at the user inputs. The brightness curve is scaled such that whatever is the highest combined duty cycle is set as 100% brightness, usually at the highest dimming voltage. It is appreciated that nothing prevents the user from using a different dimming voltage.

For purposes of explanation, numerous specific details are set forth in order to provide a thorough understanding of the disclosure. It will be apparent, however, to one skilled in the art, that the disclosure may be practiced without these specific details. In other instances, structures and devices are shown at block diagram form only in order to avoid obscuring the disclosure.

Reference throughout this specification to "one embodiment" or "an embodiment" means that a particular feature, structure, or characteristic described in connection with the embodiment is included in at least one embodiment of the present technology. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand") or a combined version (e.g., "ondemand"), a capitalized entry (e.g., "Software") may be interchangeably used with its non-capitalized version (e.g., "software"), a plural term may be indicated with or without an apostrophe (e.g., LED's or LEDs), an italicized term (e.g., "N+1") may be interchangeably used with its non-italicized version (e.g., "N+1"), and a plurality of similar elements may be referenced with a number followed by an $n^{th}$ value (e.g. "16-*n*"). Such occasional interchangeable uses shall not be considered inconsistent with each other.

In addition, some embodiments may be described in terms of "means for" performing a task or set of tasks. It will be understood that a "means for" may be expressed herein in terms of a structure, such as a processor, a memory, an I/O device such as a camera, or combinations thereof. Alternatively, the "means for" may include an algorithm that is descriptive of a function or method step, while in yet other embodiments the "means for" is expressed in terms of a mathematical formula, prose, or as a flow chart or signal diagram.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is noted at the outset that the terms "coupled", "connected", "connecting", "electrically connected", etc., are used interchangeably herein to generally refer to the condition of being electrically/electronically connected. Similarly, a first entity is considered to be in "communication" with a second entity (or entities) when the first entity electrically sends and/or receives (whether through wireline or wireless means) information signals (whether containing data information or non-data/control information) to the second entity regardless of the type (analog or digital) of those signals. It is further noted that various figures (including component diagrams) shown and discussed herein are for illustrative purpose only, and are not drawn to scale.

One skilled in the art will recognize that the Internet service may be configured to provide Internet access to one or more computing devices that are coupled to the Internet service, and that the computing devices may include one or more processors, buses, memory devices, display devices, input/output devices, and the like. Furthermore, those skilled in the art may appreciate that the Internet service may be coupled to one or more databases, repositories, servers, and the like, which may be utilized in order to implement any of the embodiments of the disclosure as described herein.

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the present technology in the form disclosed. Many modifications and variations will be apparent to those of ordinary skill in the art without departing from the scope and spirit of the present technology. Exemplary embodiments were chosen and described in order to best explain the principles of the present technology and its practical application, and to enable others of ordinary skill in the art to understand the present technology for various embodiments with various modifications as are suited to the particular use contemplated. Aspects of the present technology are described above with reference to flowchart illustrations and/or block diagrams of methods, apparatus (systems) and computer program products according to embodiments of the present technology. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that is capable of directing a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and/or block diagrams in the Figures illustrate the architecture, functionality, and operation of possible implementations of systems, methods and computer program products according to various embodiments of the present technology. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, is configured or configurable to be implemented by special purpose hardware-based systems that perform the specified functions or acts, or combinations of special purpose hardware and computer instructions.

While embodiments of the light device system and method have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. Moreover, although controlling a dimming function of a LED light device have been described, it should be appreciated that the light device system and method herein described is also suitable for reprogramming a microcontroller that provides an output signal to operate a switch utilized in controlling power to a device.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A light device system comprising:

at least one light emitting diode (LED) light source;

at least one switch operably connected to said LED light source;

at least one microcontroller in operable communication with said switch, said microcontroller being configured to receive a dimming signal from a dimming control and at least one production curve from an interface, and configured to apply at least one output signal to said switch, said at least one production curve being associated with said LED light source, said output signal being at least partially based on said production curve;

wherein said production curve is at least partially based on at least one input received by said interface;

wherein said output signal is at least two independent output signals each associated with a duty cycle step, and wherein said input is a cool LED color temperature value and a warm LED color temperature value;

wherein one of said duty cycle step is based on said production curve being an average CCT associated with a warm LED duty cycle percentage and a cool LED duty cycle percentage; and wherein a second of said duty cycle step is based on a second curve being a brightness associated with a warm LED duty cycle value, a cool LED duty cycle value, and a maximum combined duty cycle value determined by said input.

2. The light device system according to claim 1, wherein said LED light source is at least a first LED light source including a first LED anode and a first LED cathode, and a second LED light source including a second LED anode and a second LED cathode.

3. The light device system according to claim 2 further comprises a dimming module operably connected with said first LED light source and said second LED light source, and wherein said switch is a first switch operably connected between said dimming module and said first LED cathode of said first LED light source, and a second switch operably connected between said dimming module and said second LED cathode of said second LED light source.

4. The light device system according to claim 1, wherein said LED light source is at least one constant voltage LED strip including multiple LEDs of different color temperature or a plurality of constant voltage LED strips with at least two of said constant voltage LED strips being of different color temperature.

5. The light device system according to claim 2, wherein said input is at least one brightness value or at least one correlated color temperature (CCT) value associated with said first LED light source and said second LED light source.

6. The light device system according to claim 5, wherein said production curve is each selected from the group consisting of a color curve associated with color temperatures along a predetermined voltage range, a brightness curve associated with brightness along said predetermined voltage range, and said color curve and said brightness curve.

7. A light device interface system comprising:

an interface associated with a computer system having at least one processor, at least one non-transitory computer-readable storage media in communication with said processor, said interface comprising at least one input receivable and usable in determining at least one production curve associated with at least one light source characteristic;

at least one microcontroller in operable communication with at least one switch operably connected to at least one LED light source, said microcontroller being configured to receive a dimming signal from a dimming control and said production curve from said interface or said computer system, and configured to apply at least one output signal to said switch, said output signal being at least partially based on said production curve;

wherein said production curve is a default curve stored in said microcontroller or is created by using said input in at least one mathematical function;

wherein said interface further comprises:

a graphical object wherein characteristic points representing at least one predefined characteristic are located at predefined coordinates in a Cartesian coordinate system;

a graphical representation of said production curve displayed in said graphical object; and wherein said input is selected on at least one of said characteristic points on said graphical representation of said production curve displayed in said graphical object; and wherein said interface further comprising an additional input for moving the selected of said at least one characteristic points on said graphical representation of said production curve resulting in said mathematical function calculating an updated production curve.

8. The light device interface system according to claim 7, wherein said LED light source is at least a first and second LED light source of different color temperature, and wherein said input is a first input being at least one brightness value or at least one CCT value associated with said first LED light source, and a second input being at least one brightness value or at least one CCT value associated with said second LED light source.

9. The light device interface system according to claim 7, wherein said production curve is a color curve associated with color temperatures along a predetermined voltage range, wherein said color temperatures of said color curve are based on said input from said interface.

10. The light device interface system according to claim 9, wherein said production curve further includes a brightness curve associated with brightness along said predetermined voltage range.

11. The light device interface system according to claim 10, wherein said output signal is each at least two independent output signals each associated with a duty cycle step, and said input is a first input being a cool LED color temperature value and a second input being a warm LED color temperature value, and wherein one of said duty cycle step is based on said production curve being an average CCT associated with a warm LED duty cycle percentage and a cool LED duty cycle percentage.

12. The light device interface system according to claim 7, wherein said production curve includes predefined color temperature targets with set points based on an incandescence curve associated with brightness and color temperature characteristics of a dimmable incandescent light.

13. The light device interface system according to claim 7, wherein said non-transitory computer-readable storage media storing instructions that, when executed by said processor, causes said processor to:

compile a code including said production curve;

determine what coefficients need to change in said code based on said input;

change said coefficients in said code to alter said production curve in said code; and store said code in said microcontroller.

14. A method of controlling a light device, said method comprising the steps of:

a) determining at least one production curve based on at least one input received by an interface or a computer system;

b) writing said production curve to a microcontroller or selecting said production curve from said microcontroller;

c) receiving by said microcontroller a dimming signal from a dimming control;

d) creating by said microcontroller at least one output signal that is based on said production curve and said dimming signal;

e) transmitting said output signal from said microcontroller to at least one switch operably connected to at least one LED light source;

f) controlling at least one attribute of said LED light source by way of said switch based on said output signal; and wherein said LED light source is at least a first and second LED light source of different color temperature, and wherein said input is at least one brightness value or at least one CCT value associated with each of said first LED light source and said second LED light source; and wherein said production curve is each selected from the group consisting of a color curve associated with color temperatures along a predetermined voltage range, a brightness curve associated with brightness along said predetermined voltage range, and said color curve and said brightness curve.

15. The method according to claim 14, wherein said output signal is each at least two independent output signals each associated with a duty cycle step, and said input is a cool LED color temperature value and a warm LED color temperature value, and wherein one of said duty cycle step is based on said production curve being an average CCT associated with a warm LED duty cycle percentage and a cool LED duty cycle percentage, and wherein a second of said duty cycle step is based on a second production curve being a brightness associated with a warm LED duty cycle value, a cool LED duty cycle value, and a maximum combined duty cycle value determined by said input.

16. A light device interface system comprising:

an interface associated with a computer system having at least one processor, at least one non-transitory computer-readable storage media in communication with said processor, said interface comprising at least one input receivable and usable in determining at least one production curve associated with at least one light source characteristic;

at least one microcontroller in operable communication with at least one switch operably connected to at least one LED light source, said microcontroller being configured to receive a dimming signal from a dimming control and said production curve from said interface or said computer system, and configured to apply at least one output signal to said switch, said output signal being at least partially based on said production curve;

wherein said production curve is a default curve stored in said microcontroller or is created by using said input in at least one mathematical function;

wherein said production curve is a color curve associated with color temperatures along a predetermined voltage range, wherein said color temperatures of said color curve are based on said input from said interface; and wherein said production curve further includes a brightness curve associated with brightness along said predetermined voltage range.

17. The light device interface system according to claim 16, wherein said LED light source is at least a first and second LED light source of different color temperature, and wherein said input is a first input being at least one brightness value or at least one CCT value associated with said first LED light source, and a second input being at least one brightness value or at least one CCT value associated with said second LED light source.

18. The light device interface system according to claim 16, wherein said interface further comprises:

a graphical object wherein characteristic points representing at least one predefined characteristic are located at predefined coordinates in a Cartesian coordinate system; and a graphical representation of said production curve displayed in said graphical object; and wherein said input is selected on at least one of said characteristic points on said graphical representation of said production curve displayed in said graphical object.

19. The light device interface system according to claim 18, wherein said interface further comprising an additional input for moving the selected of said at least one characteristic points on said graphical representation of said production curve resulting in said mathematical function calculating an updated production curve.

20. The light device interface system according to claim 16, wherein said output signal is each at least two independent output signals each associated with a duty cycle step, and said input is a first input being a cool LED color temperature value and a second input being a warm LED color temperature value, and wherein one of said duty cycle step is based on said production curve being an average CCT associated with a warm LED duty cycle percentage and a cool LED duty cycle percentage.

21. The light device interface system according to claim 16, wherein said production curve includes predefined color temperature targets with set points based on an incandescence curve associated with brightness and color temperature characteristics of a dimmable incandescent light.

22. The light device interface system according to claim 16, wherein said non-transitory computer-readable storage media storing instructions that, when executed by said processor, causes said processor to:

compile a code including said production curve;

determine what coefficients need to change in said code based on said input;

change said coefficients in said code to alter said production curve in said code; and store said code in said microcontroller.

23. A light device interface system comprising:

an interface associated with a computer system having at least one processor, at least one non-transitory computer-readable storage media in communication with said processor, said interface comprising at least one input receivable and usable in determining at least one production curve associated with at least one light source characteristic;

at least one microcontroller in operable communication with at least one switch operably connected to at least one LED light source, said microcontroller being configured to receive a dimming signal from a dimming control and said production curve from said interface or said computer system, and configured to apply at least one output signal to said switch, said output signal being at least partially based on said production curve;

wherein said production curve is a default curve stored in said microcontroller or is created by using said input in at least one mathematical function; and wherein said non-transitory computer-readable storage media storing instructions that, when executed by said processor, causes said processor to:

compile a code including said production curve;

determine what coefficients need to change in said code based on said input;

change said coefficients in said code to alter said production curve in said code; and store said code in said microcontroller.

24. The light device interface system according to claim 23, wherein said LED light source is at least a first and second LED light source of different color temperature, and wherein said input is a first input being at least one brightness value or at least one CCT value associated with said first LED light source, and a second input being at least one brightness value or at least one CCT value associated with said second LED light source.

25. The light device interface system according to claim 23, wherein said interface further comprises:

a graphical object wherein characteristic points representing at least one predefined characteristic are located at predefined coordinates in a Cartesian coordinate system; and a graphical representation of said production curve displayed in said graphical object; and wherein said input is selected on at least one of said characteristic points on said graphical representation of said production curve displayed in said graphical object.

26. The light device interface system according to claim 25, wherein said interface further comprising an additional input for moving the selected of said at least one characteristic points on said graphical representation of said production curve resulting in said mathematical function calculating an updated production curve.

27. The light device interface system according to claim 23, wherein said production curve is a color curve associated with color temperatures along a predetermined voltage range, wherein said color temperatures of said color curve are based on said input from said interface.

28. The light device interface system according to claim 9, wherein said production curve further includes a brightness curve associated with brightness along said predetermined voltage range.

29. The light device interface system according to claim 28, wherein said output signal is each at least two independent output signals each associated with a duty cycle step, and said input is a first input being a cool LED color temperature value and a second input being a warm LED color temperature value, and wherein one of said duty cycle step is based on said production curve being an average CCT associated with a warm LED duty cycle percentage and a cool LED duty cycle percentage.

30. The light device interface system according to claim 23, wherein said production curve includes predefined color temperature targets with set points based on an incandescence curve associated with brightness and color temperature characteristics of a dimmable incandescent light.

31. A method of controlling a light device, said method comprising the steps of:

a) determining at least one production curve based on at least one input received by an interface or a computer system;

b) writing said production curve to a microcontroller or selecting said production curve from said microcontroller;

c) receiving by said microcontroller a dimming signal from a dimming control;

d) creating by said microcontroller at least one output signal that is based on said production curve and said dimming signal;

e) transmitting said output signal from said microcontroller to at least one switch operably connected to at least one LED light source; and f) controlling at least one attribute of said LED light source by way of said switch based on said output signal; and wherein said output signal is each at least two independent output signals each associated with a duty cycle step, and said input is a cool LED color temperature value and a warm LED color temperature value, and wherein one of said duty cycle step is based on said production curve being an average CCT associated with a warm LED duty cycle percentage and a cool LED duty cycle percentage, and wherein a second of said duty cycle step is based on a second production curve being a brightness associated with a warm LED duty cycle value, a cool LED duty cycle value, and a maximum combined duty cycle value determined by said input.

32. The method according to claim 31, wherein said LED light source is at least a first and second LED light source of different color temperature, and wherein said input is at least one brightness value or at least one CCT value associated with each of said first LED light source and said second LED light source, and wherein said production curve is each selected from the group consisting of a color curve associated with color temperatures along a predetermined voltage range, a brightness curve associated with brightness along said predetermined voltage range, and said color curve and said brightness curve.

* * * * *